US005084056A

United States Patent [19]

Eckel et al.

[11] Patent Number: 5,084,056

[45] Date of Patent: Jan. 28, 1992

[54] DEPILATION APPARATUS

[75] Inventors: Merowech Eckel; Peter Malobabic, both of Klagenfurt; Johann Unteregger, Brückl, all of Austria

[73] Assignee: U.S. Philips Corp., New York, N.Y.

[21] Appl. No.: 359,467

[22] Filed: May 31, 1989

[30] Foreign Application Priority Data

Feb. 10, 1989 [AT] Austria ..... 287/89

[51] Int. Cl.[5] ..... A61B 17/50

[52] U.S. Cl. ..... 606/133; 452/83

[58] Field of Search ..... 606/131, 133; 17/11.1 R, 47; 132/73, 73.6; 452/71, 82, 83, 102

[56] References Cited

U.S. PATENT DOCUMENTS 1,218,174 3/1917 Faint .
2,004,581 6/1935 Meyer ..... 606/133
2,112,230 3/1938 Fisher .
4,279,253 7/1981 Haes et al. .
4,811,458 3/1989 Nieuwelaar et al. .
4,917,678 4/1990 Locke et al. ..... 606/133

FOREIGN PATENT DOCUMENTS 0245141 11/1987 European Pat. Off. .
2079667 11/1971 France .
0652899 12/1985 Sweden .

*Primary Examiner*—C. Fred Rosenbaum
*Assistant Examiner*—William W. Lewis
*Attorney, Agent, or Firm*—Ernestine C. Bartlett

[57] ABSTRACT

A depilation apparatus is provided which comprises at least one pair of depilation rollers (3, 4; 5, 6) arranged at the location of an opening (2) in the apparatus for access to their circumferential surfaces, which rollers are rotatably supported, which are rotatable in opposite directions, and which cooperate circumferentially with one another, the depilation rollers being supported to project freely with one of their end portions and the opening in the apparatus at least partly exposing the freely projecting end portions of the depilation rollers.

16 Claims, 4 Drawing Sheets

5084056

DEPILATION APPARATUS

FIELD OF THE INVENTION

The invention relates to a depilation apparatus comprising at least one pair of depilation rollers which are arranged at the location of an opening in the apparatus which provides access to their circumferential surfaces, which are rotatably supported, which are rotatable in opposite directions, and which cooperate circumferentially with one another, of which one roller can be driven by means of a motor, the depilation rollers performing a rotary movement which is directed into the interior of the apparatus at the location where said rollers cooperate circumferentially.

BACKGROUND OF THE INVENTIONS

Such a depilation apparatus is disclosed in FR-PS 2,079,667. In this known depilation apparatus the depilation rollers are rotatably supported in the apparatus by journals provided at both ends of the rollers, the opening in the apparatus adjoining the ends of the depilation rollers.

SUMMARY OF THE INVENTIONS

It is an object of the invention to improve the operation of a depilation apparatus of the type defined in the opening sentence in such a way that the hairs to be extracted are caught and extracted from their follicles by the depilation rollers as reliably as possible in order to assure a satisfactory and rapid depilation. According to the invention this is achieved in that the depilation rollers are supported to project freely with one of their end portions and in that the opening in the apparatus at least partly exposes the freely projecting end portions of the depilation rollers. In this way, depilation is performed not only along the length of the depilation rollers but also one end of each depilation roller, namely the freely projecting end portion, assists in depilation, which provides a very effective depilation. This is because it has been found that the hairs to be removed are gripped very reliably and effectively by the freely projecting end portions of the depilation rollers and are thus subjected to the depilation process.

In a depilation apparatus comprising at least two pairs of depilation rollers it is found to be very advantageous if the two pairs of depilation rollers, disposed axially in tandem, are arranged to be coaxial with each other and the freely projecting end portions of the depilation rollers of the both pairs are remote from one another. In this way the depilation rollers have end portions which project freely in both longitudinal directions of the depilation rollers, which may be compared with the situation that both end portions of one depilation roller project freely. Thus, more freely projecting end portions of the depilation rollers, viewed in both longitudinal directions of the depilation rollers, can partake in the depilation, so that a further improvement of the depilation process is obtained.

In a preferred embodiment the coaxial depilation rollers of the two pairs comprise a roller shaft common to said pairs. This results in a simpler construction because the coaxial depilation rollers can be supported and driven jointly.

Preferably the coaxial depilation rollers which are driven by the motor are rigidly connected to their roller shaft and the other coaxial depilation rollers are arranged on their roller shaft so as to be freely rotatable and to be axially movable to a limited extent. The result is that in the circumferential direction the depilation rollers which are arranged to be freely rotatable and to be axially movable to a limited extent can very effectively adapt themselves to the depilation rollers of a pair cooperating with them, so that the circumferential cooperation of a depilation-roller pair proceeds very satisfactorily and reliably, which is very important for the depilation process. Such circumferential cooperation is found to be particularly effective if the circumferential surfaces of the depilation rollers have an undulatory cross-sectional profile, as is known per se from FR-PS 2,079,667 referred to above, because a reliable and correct circumferential interengagement of the depilation rollers of a pair is then also assured in the event of tolerances in the manufacture of the depilation rollers.

It is obvious that various technical possibilities are available for arranging a depilation roller on its roller shaft so as to be freely rotatable and axially movable to a limited extent. However, it is preferably if, for the limited axial movement of a depilation roller on its roller shaft, the depilation roller is provided with a collar at its end which is remote from the freely projecting end portion, which collar engages behind that end of the adjacent depilation roller which is remote from the freely projecting end portion. It will be seen that such a construction is very simple.

Preferably the freely projecting end portions of the depilation rollers are rounded. This further promotes gripping of the hairs by the freely projecting end portions of the depilation rollers and precludes irritation of the skin. For rounding a variety of shapes may be adopted, such as for example, circular, elliptical or frustoconical shapes.

In a depilation apparatus in which the circumferential surfaces of the depilation rollers have an undulatory cross-sectional profile it is then also preferred that the undulatory cross-sectional profile of the depilation rollers extends into the rounded end portions of said rollers. This feature also promotes a reliable gripping of the hairs by the freely projecting end portions of the depilation rollers.

In a depilation apparatus in which the circumferential surfaces of the depilation rollers have an undulatory cross-sectional profile it is further, preferred that the ends of the crests of the undulatory cross-sectional profiles of the depilation rollers, which ends are situated at the location of the rounded end portions of the depilation rollers, are also rounded. This feature also reduces irritation of the skin and contributes to a reliable gripping of the hairs by the freely projecting end portions of the depilation rollers.

In a preferred embodiment of the invention, a protective comb associated with the depilation rollers is provided, which comb extends over the opening in the apparatus and comprises spaced-apart comb teeth which extend in the axial direction of the depilation rollers. By means of such a protective comb, the skin is kept away from the depilation rollers and, as a result of the comb action, the hairs are guided towards the depilation rollers, an essential feature being that the comb teeth extend in the axial direction of the depilation rollers, in conformity with the direction of the freely projecting end portions of the depilation rollers. It is to be noted that it is known per se from FR-PS 2,307,491 to shield the depilation rollers of a depilation apparatus with a protection device similar to a shear plate, but the hair-entry apertures in this shear plate extend obliquely relative to the longitudinal direction of the depilation rollers, which does not provide a very effective entry of the hairs to the depilation rollers. Conversely, in the case of the present protective comb the comb teeth are directly aligned in the axial direction of the depilation rollers, thereby providing a very effective hair entry to the depilation rollers.

Preferably two adjacent comb teeth of the protective comb directly expose the area in which the depilation rollers of a pair cooperate circumferentially with one another. This provides a direct entry of the hairs to the gripping area of the cooperating depilation rollers of a pair, so that depilation proceeds very effectively.

It is also preferred that the comb teeth of the protective comb at least partly enclose the freely projecting end portions of the depilation rollers which are exposed by the opening in the apparatus. This provides both a comb action and a protection of the skin at the location of the freely projecting end portions of the depilation rollers.

It is especially preferred if, at the location where they at least partly enclose the freely projecting end portions of the depilation rollers, the comb teeth of the protective comb have an acute V-shape. In this way the hairs are erected, so that they are gripped very effectively by the freely projecting end portions of the depilation rollers.

Preferably the comb teeth of the protective comb are tapered at the location where they at least partly enclose the freely projecting end portions of the depilation rollers. Thus, at the location of the freely projecting end portions of the depilation rollers, the spacing between the comb teeth is larger, i.e. the tooth gap is larger thereby further improving the access of the hairs to the freely projecting end portions of the depilation rollers.

It is also preferred that the protective comb associated with the depilation rollers be constructed as a protective cover surrounding the depilation rollers. In addition to a simple construction this provides an effective skin protection all round the depilation rollers.

It is further preferred that the protective comb associated with the depilation rollers is arranged to be movable on the apparatus in a direction transverse to the axial direction of the depilation rollers for optionally exposing or covering the depilation rollers. This enables depilation to be effected either with or without the protective comb, as desired, and in the exposed position it also enables the depilation rollers to be cleaned.

Optionally, the protective comb associated with the depilation rollers may be constructed to be detachable from the apparatus. In this way it is also possible to effect depilation either with or without the protective comb and it is also simple to clean the depilation rollers.

BRIEF DESCRIPTION OF THE DRAWINGS

Embodiments of the invention will now be described in more detail, by way of non-limitative example, with reference to the accompanying drawings in which.

DETAILED DESCRIPTION OF PREFERRED EMBODIMENTS

Figure 1:
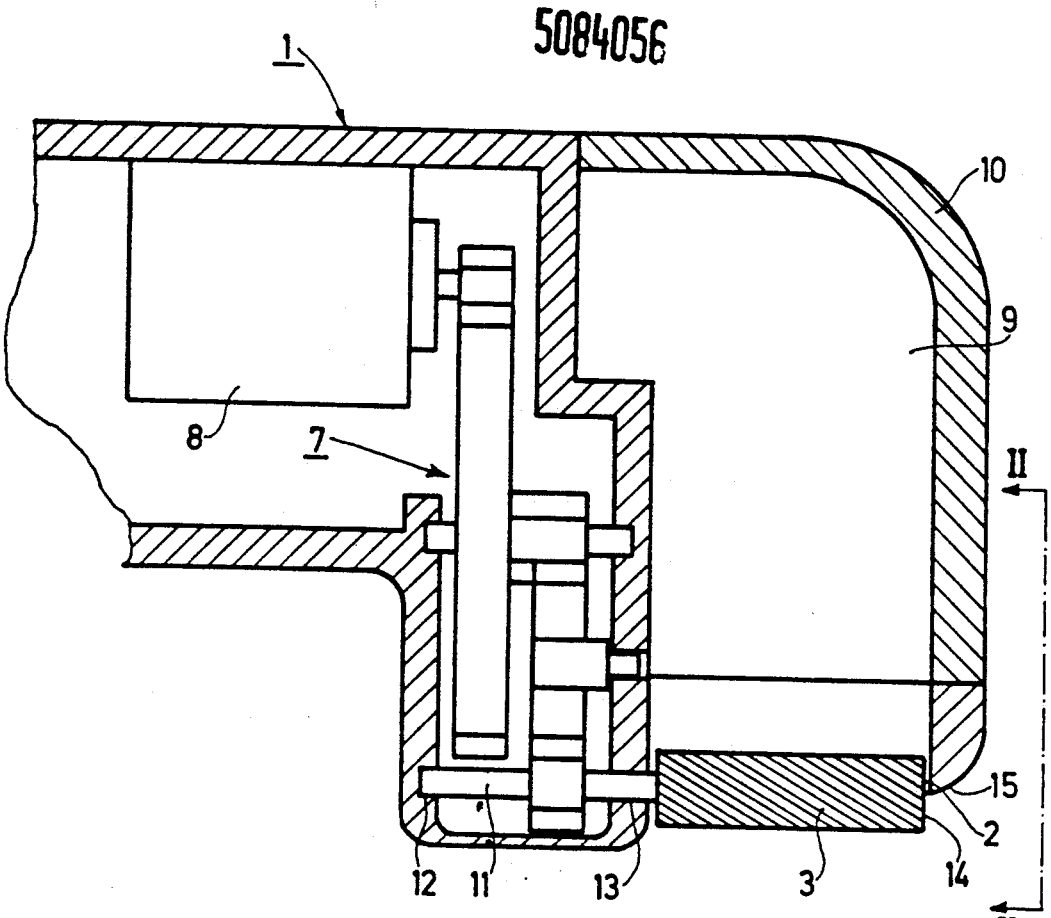
FIG. 1 is a longitudinal sectional view showing a part of a depilation apparatus which for the removal of hairs comprises two pairs of depilation rollers which are arranged at the location of an opening in the apparatus so as to be rotatable in opposite directions, the depilation rollers being supported to have one freely protruding end portion and the opening in the apparatus partly exposing the freely projecting end portions of the depilation rollers.
Figure 2:
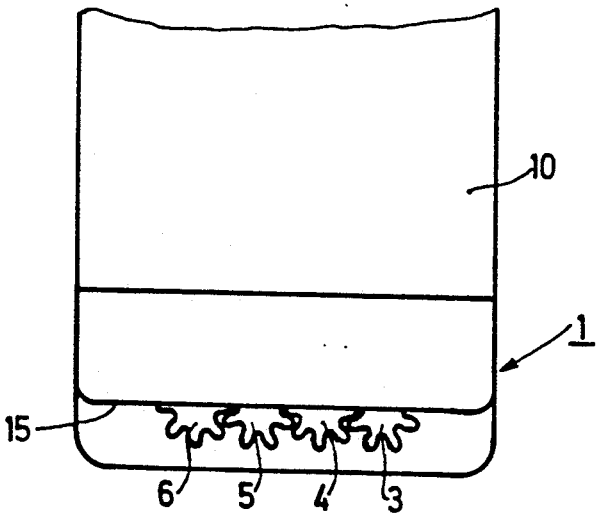
FIG. 2 shows a part of the depilation apparatus in a plan view taken on the line II—II in FIG. 1.

In FIGS. 1 and 2 the housing 1 of a depilation apparatus has an opening 2 at the location of which two pairs of depilation rollers 3, 4 and 5, 6 are rotatably arranged. The depilation rollers of every pair 3, 4 and 5, 6 cooperate circumferentially with one another and are rotatable in opposite directions, the depilation rollers of each pair performing a rotation which is directed into the interior of the apparatus at the location where they cooperate circumferentially. As can be seen in FIG. 2, the circumferential surfaces of the depilation rollers 3, 4, 5 and 6 in the present embodiment have undulatory cross-sectional profiles with which the depilation rollers of each pair interengage circumferentially. In the present embodiments the depilation roller 4 of the depilation-roller pair 3, 4 also engages circumferentially with the undulatory cross-sectional profile of the depilation roller 5 of the depilation-roller pair 5, 6, so that all the depilation rollers 3, 4, 5 and 6 can be driven by means of one motor. For this purpose the depilation roller 3 is driven by means of a motor 8 via, for example, a multi-stage gear mechanism 7, the direction of rotation being selected in such a way that the depilation roller 3 performs a rotation which is directed into the interior of the apparatus at the location where it circumferentially cooperates with the depilation roller 4. As a result of the circumferential cooperation of the depilation roller 3 with the depilation roller 4 the latter is driven in a direction of rotation which is also directed into the interior of the apparatus at the location where it cooperates circumferentially with the depilation roller 3. For this direction of rotation of the depilation roller 4, the depilation roller 5 is then also driven in a direction of rotation which is again directed into the interior of the apparatus at the location where it cooperates circumferentially with the depilation roller 6, so that the depilation roller 6 is also driven in a direction of rotation which is directed into the interior of the apparatus at the location where it cooperates circumferentially with the depilation roller 5. In this way the depilation rollers 3, 4 and 5, 6 of each pair are capable of gripping a hair which is caught between them and of exerting a pulling force on this hair to extract it from its follicle. Subsequently, the depilation rollers feed a hair thus removed into an adjoining collecting chamber 9 of the depilation apparatus. For cleaning purposes this collecting chamber 9 may be closed, for example by means of a cover 10 which is detachable from the apparatus housing 1. It is to be noted that it is not essential for the circumferential surfaces of the depilation rollers to have an undulatory cross-sectional profile, which circumferential surfaces may also be smooth, although an undulatory cross-sectional profile of the circumferential surfaces has proved to provide a more effective depilation.

In a depilation apparatus of such a type it is found to be very advantageous if the depilation rollers are supported to have one freely projecting end portion and if the opening 2 in the apparatus at least partly exposes the freely projecting end portions of the depilation rollers. FIG. 1 shows how the depilation roller 3 is supported to obtain one freely projecting end portion. For this purpose one end of the depilation roller 3 is provided with a drive shaft 11, which is supported in two hearings 12 and 13 in the apparatus, so that the end portion 14 of the depilation roller 3 which is remote from the drive shaft 11 projects freely. To drive the depilation roller 3 its drive shaft 11 may carry a gear wheel, which cooperates with the gear mechanism 7. The depilation rollers 4, 5 and 6 may also be supported in this way so that all the depilation rollers 3, 4 and 5, 6 of both pairs have freely projecting end portions. The opening 2 in the apparatus is formed in such a way that it exposes the freely projecting end portions of the depilation rollers partly, for example, when each opening is formed wherein an edge portion 15 of the apparatus housing 1 suitably recedes relative to the ends of the depilation rollers, as can be seen in FIGS. 1 and 2.

Because of the steps described above the depilation rollers 3, 4 and 5, 6 of every pair cannot only partake in the depilation process along their lengths but also with their freely projecting end portions by which, as is found in practice, the hairs are gripped very effectively and subjected to depilation. As a result of this depilation proceeds very rapidly and reliably if the depilation apparatus is passed over the skin with the freely projecting end portions of the depilation rollers facing forward.

Figure 3:
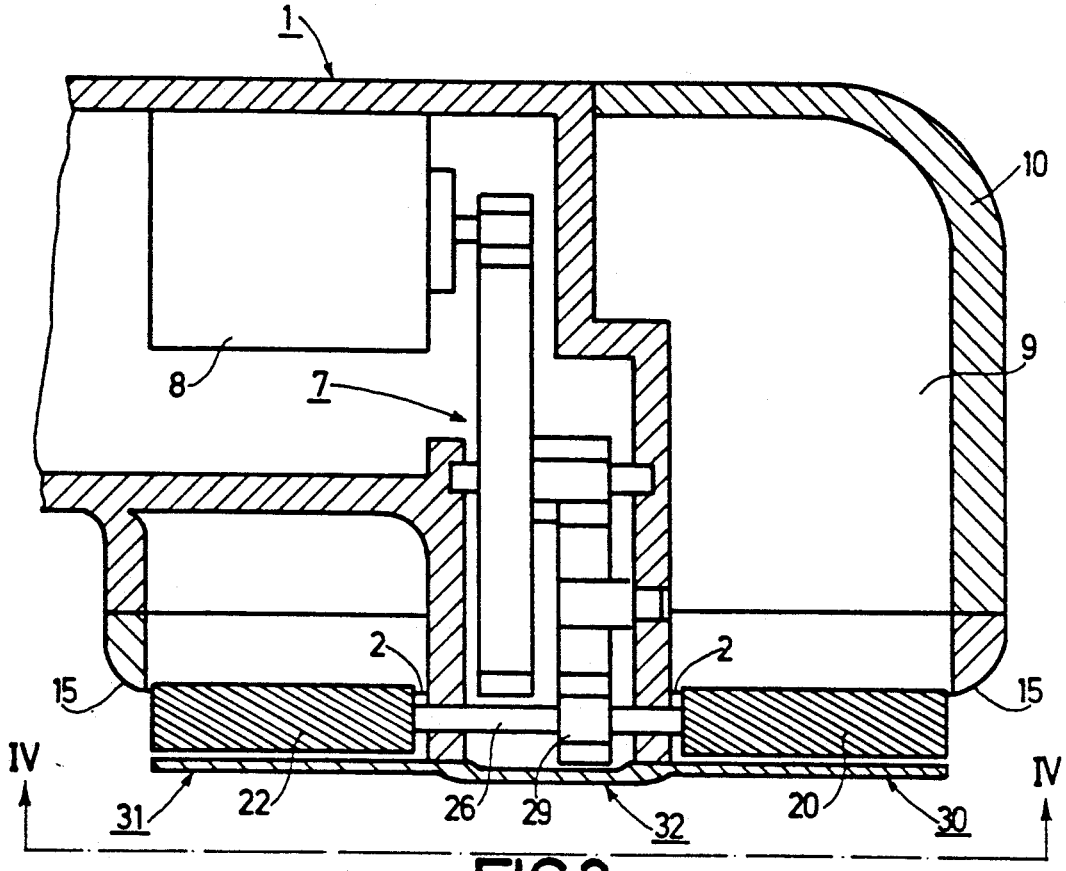
FIG. 3 is a longitudinal sectional view showing a depilation apparatus comprising four pairs of depilation rollers with associated protective combs, of which two pairs of depilation rollers are arranged axially in tandem so as to be coaxial with each other, the freely projecting end portions of the depilation rollers of every two pairs being remote from one another.
Figure 4:
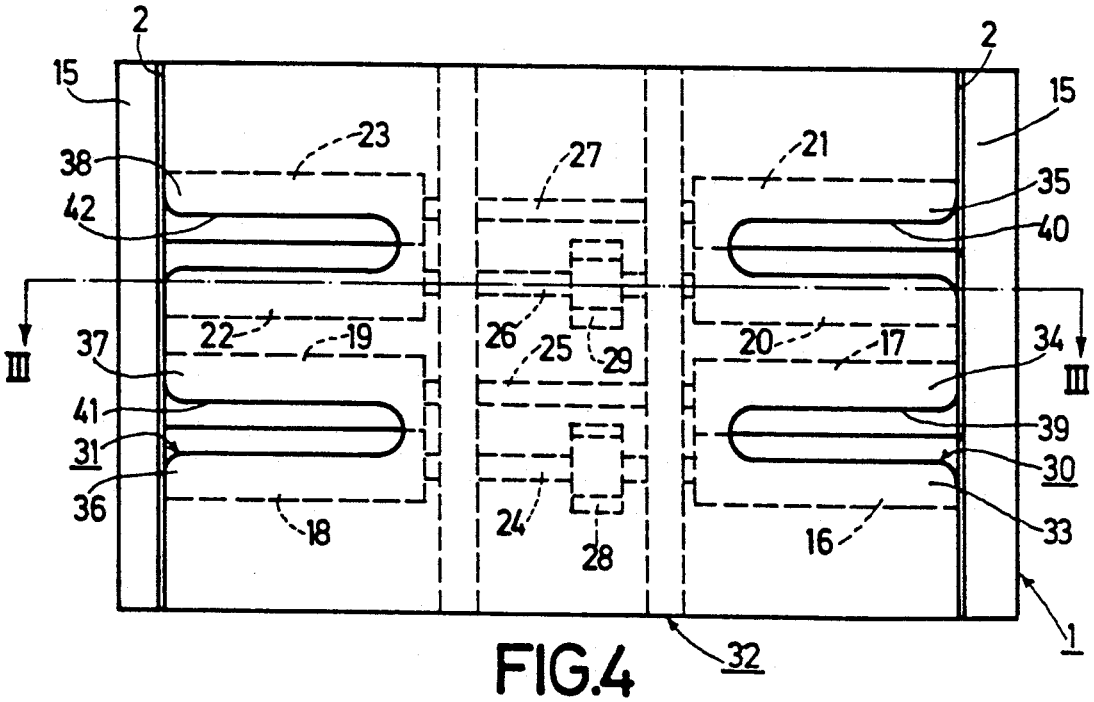
FIG. 4 shows a part of the depilation apparatus in a plan view taken on the line IV—IV in FIG. 3.

In the embodiment shown in FIGS. 3 and 4, each time two pairs of four pairs of depilation rollers are arranged in tandem so as to be coaxial with one another, the freely projecting end portions of the depilation rollers of these two pairs being remote from one another. In FIGS. 3 and 4 two depilation roller pairs arranged in tandem are referenced 16, 17 and 18, 19 and two further depilation roller pairs arranged in tandem are referenced 20, 21 and 22, 23, the depilation rollers 16, 18 and 17, 19 as well as 20, 22 and 21, 23 being axially aligned, as can be seen. In the present case these coaxial depilation rollers have a common roller shaft bearing the reference numeral 24 for the depilation rollers 16, 18, the reference numeral 25 for the depilation rollers 17, 19, the reference numeral 26 for the depilation rollers 20, 22, and the reference numeral 27 for the depilation rollers 21, 23. These roller shafts 24, 25, 26 and 27 are journalled in the apparatus with their central portions, so that each of the depilation rollers has a freely projecting end portion, the freely projecting end portions of the depilation rollers 16, 17, 20, 21 and the freely projecting end portions of the depilation rollers 18, 19, 22 and 23 being remote from one another. In the present case the depilation roller pairs 16, 17 and 18, 19, viewed in a direction transverse to the longitudinal direction of the depilation rollers, are spaced from the depilation-roller pairs 20, 21 and 22, 23, which means that the adjacent depilation rollers 17, 20 and 19, 22 do not circumferentially cooperate with one another. Therefore, each of the two coaxial depilation-roller pairs is driven separately, the depilation rollers 16 and 18 being driven by a gear wheel 28 on the roller shaft 24 and the depilation rollers 20 and 22 being driven by a gear wheel 29 on the roller shaft 26, said gear wheels 28 and 29 again cooperating with a gear mechanism 7 driven by the motor 8. Again the opening 2 in the apparatus partly exposes the freely projecting end portions of the depilation rollers, which is again achieved in that the edge 15 of the apparatus housing 1 recedes relative to the freely projecting end portions of the depilation rollers, in such a way that in the present case the freely projecting end portions of the depilation rollers are almost wholly exposed as can be seen in FIG. 3.

A depilation apparatus constructed in the same way as the embodiment described above has the advantage that, viewed in the two longitudinal directions of the depilation rollers, freely projecting end portions of the depilation rollers, namely those of the depilation rollers 16, 17, 20 and 21 at one end and the depilation rollers 18, 19, 22 and 23 at the other end, can partake in the depilation process. This means that if the depilation apparatus is moved to and fro over the skin in the longitudinal direction of the depilation rollers the freely projecting end portions of the depilation rollers are operative in both directions of movement, so that a very rapid and reliable depilation is achieved.

Since the opening 2 in the apparatus exposes not only the circumferential surfaces of the depilation rollers but also the freely projecting end portions of the depilation rollers at least partly, it is found to be advantageous in this respect if the depilation rollers are provided with an associated protective comb which extends over the opening in the apparatus and which has spaced-apart comb teeth extending in the axial directions of the depilation rollers. In the present embodiment protective comb 30 is provided for the depilation rollers 16, 17, 20 and 22 and protective comb 31 for the depilation rollers 18, 19, 22 and 23, the two protective combs 30 and 31 in the present case being integrated to form a single member 32. The protective comb 30 comprises three comb teeth 33, 34 and 35, the comb teeth 33 and 34 being associated with the depilation-roller pair 16, 17 and the comb teeth 35 and, again 34 being associated with the depilation-roller pair 20, 21. The protective comb 31 comprises three comb teeth 36, 37 and 38, the comb teeth 36 and 37 being associated with the depilation-roller pair 18, 19 and the comb teeth 38 and, again 37 being associated with the depilation-roller pair 22, 23. As can be seen in FIG. 4, the comb teeth associated with every depilation-roller pair are constructed in such a way that they directly expose the area in which the depilation rollers of the relevant pair cooperate circumferentially, which means that in these areas of the depilation roller pairs tooth gaps are situated, which are referenced 39, 40, 41 and 42. By means of such protective combs it is achieved that the skin is kept away from the depilation rollers and, as a result of a comb action, the hairs are guided towards the depilation rollers, an essential feature being that the comb teeth extend in the axial direction of the depilation rollers, in conformity with the direction of the freely projecting end portions of the depilation rollers, and that a tooth gap directly exposes the area where the depilation rollers of a pair cooperate circumferentially. This provides a very effective hair entry to the depilation rollers, resulting in a correct operation of the depilation rollers and their freely projecting end portions. The hairs can directly reach the gripping area of the cooperating depilation rollers of a pair, in particular, because two adjacent comb teeth always expose exactly the area in which the depilation rollers of a pair cooperate circumferentially, so that the depilation process is very effective. As is apparent from the foregoing, this is possible by means of a small number of comb teeth, which may be attributed to the fact that in practice depilation rollers of a comparatively small diameter are used, said diameter being suitably about 4.5 mm.

Figure 5:
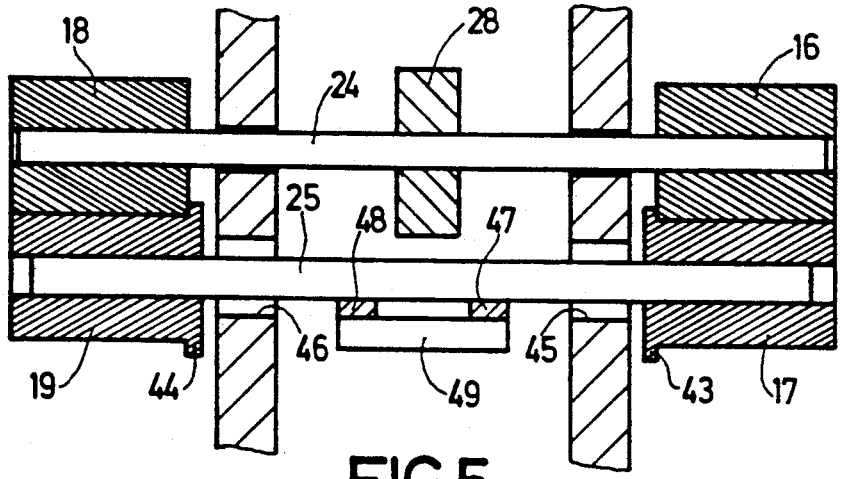
FIG. 5 shows diagrammatically two pairs of depilation rollers which are arranged axially in tandem so as to be coaxial with one another, the coaxial depilation rollers of the two pairs having a common roller shaft, the coaxial depilation rollers which are driven by the motor being rigidly connected to the roller shaft, and the other coaxial depilation rollers being arranged on their roller shaft so as to be freely rotatable and axially movable to a limited extent.

An especially preferred arrangement of two pairs of depilation rollers 16, 17 and 18, 19 will now be described with reference to FIG. 5, said rollers being again arranged axially in tandem so as to be coaxial with one another, the freely projecting ends of the depilation rollers of the two pairs being remote from one another, in the same way as in the embodiments shown in FIGS. 3 and 4. Again, the axially lined-up depilation rollers 16, 18 and 17, 19 of the two depilation-roller pairs 16, 17 and 18, 19 respectively have a common roller shaft 24 and 25 respectively, the lined-up depilation rollers 16 and 18 which are driven by the motor via a gear wheel 28 being rigidly connected to their roller shaft 24. However, the other lined-up depilation rollers 17 and 19 are arranged on their roller shaft 25 so as to be freely rotatable and axially movable to a limited extent. To achieve the limited axial movement of the depilation rollers 17 and 19 on their roller shaft 25 it is found to be preferable if at their ends which are remote from their freely projecting ends the depilation rollers 17 and 19 are provided with collars 43 and 44 respectively, with which they engage behind the non-free ends of the adjacent depilation rollers 16 and 17 respectively, the depilation rollers 17 and 19 themselves being freely rotatable on their roller shaft 25. This ensures a correct circumferential cooperation between the depilation rollers 16, 17 and 18, 19 of the two pairs. Moreover, the depilation rollers 17 and 19 in the present embodiment are circumferentially urged against the adjacent depilation rollers 16 and 18 under spring force, which is achieved in that the roller shaft 25 is movably supported in slots 45 and 46 in the housing and in that two limbs 47 and 48 of blade spring 49 act upon them to urge the roller shaft 25 towards the roller shaft 24. This provides an even better circumferential cooperation between the depilation rollers of the two pairs, which is found to be particularly advantageous if the circumferential surfaces of the depilation rollers have an undulatory cross-sectional profile, because tolerances in the manufacture of the depilation rollers are then compensated for while said rollers cooperate circumferentially. It will be appreciated that if only one pair of depilation rollers has been provided it is also possible to urge the depilation rollers circumferentially towards one another under spring pressure.

Figure 6:
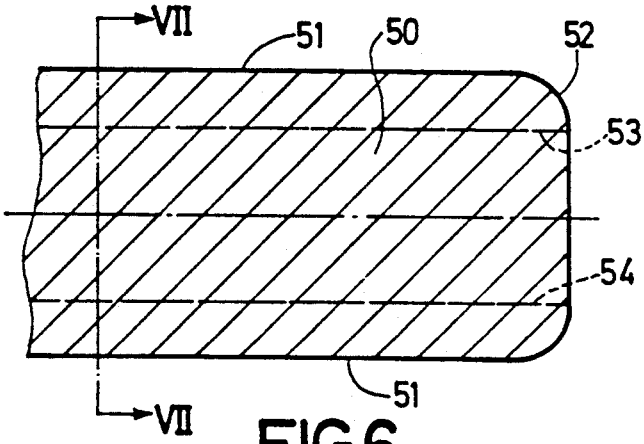
FIG. 6 is a sectional view showing the freely projecting end portion of a depilation roller whose circumferential surface has an undulatory cross-sectional profile, which end portion is rounded.
Figure 7:
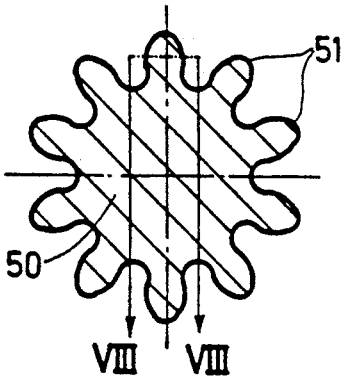
FIG. 7 is a sectional view of the depilation roller, taken on the line VII—VII in FIG. 6 and shows the undulatory cross-sectional profile of the circumferential surface of the depilation roller.
Figure 8:
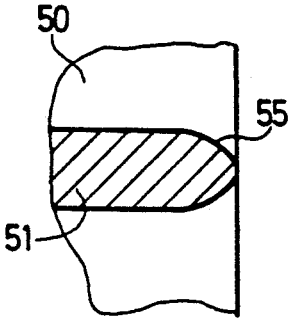
FIG. 8 shows a crest of the undulatory cross-sectional profile of the depilation roller in a sectional view taken on the line VIII—VIII in FIG. 7.

For the construction of the depilation rollers themselves it is further found to be advantageous if their freely projecting end portions are rounded. This results in a further improvement of the hair gripping action provided by the freely projecting end portions of the depilation rollers and, moreover it precludes irritation of the skin. FIGS. 6, 7 and 8 show such a freely projecting end portion of a depilation roller 50, whose circumferential surface is assumed to have an undulatory cross-sectional profile which in the present case takes the form of a toothed-wheel profile having teeth with rounded tops and which comprises a total of seven teeth or crests 51, as is illustrated in FIG. 7. FIG. 6 shows the rounding 52 of the freely projecting end portion of the depilation roller 50. In this case said rounding 52 is circular but alternatively it may be, for example, elliptical or frustoconical. It is found to be effective if the undulatory cross-sectional profile of the depilation roller extends into the rounded end portion, as is indicated by the broken lines 53 and 54 in FIG. 6 for two crests of the cross-sectional profile. This further promotes a reliable gripping of the hairs by the freely projecting end portions of the depilation rollers. It is further found to be advantageous if at the location of the rounded end portion of the depilation roller the ends of the crests of the undulatory cross-sectional profile of the depilation roller are also rounded, as is illustrated in FIG. 8 for a crest 51 whose rounding bears the reference numeral 55. Such an additional rounding of the crests of the undulatory cross-sectional profile provides a very gentle cooperation of the freely projecting ends of the depilation rollers with the skin. Thus, the freely projecting end of the depilation roller is given a rounded star shape, so that the hairs are guided very effectively towards the gripping areas of the depilation rollers of a pair.

Figure 9:
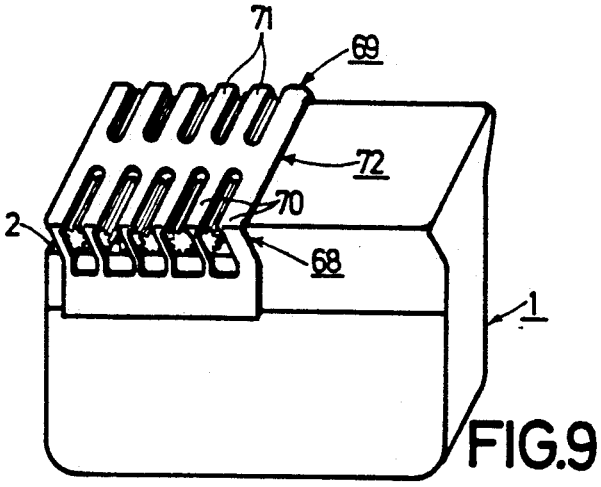
FIG. 9 shows a depilation apparatus comprising protective combs forming part of a protective cover for the depilation rollers, which cover is movable on and detachable from the apparatus.
Figure 10:
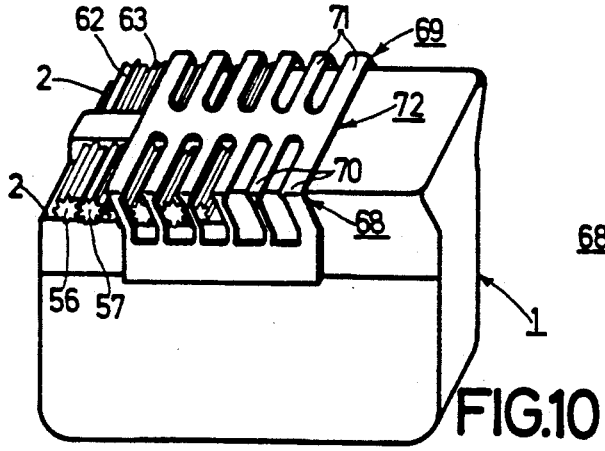
FIG. 10 shows the depilation apparatus of FIG. 9 with the protective cover partly slid away from the depilation rollers.
Figure 11:
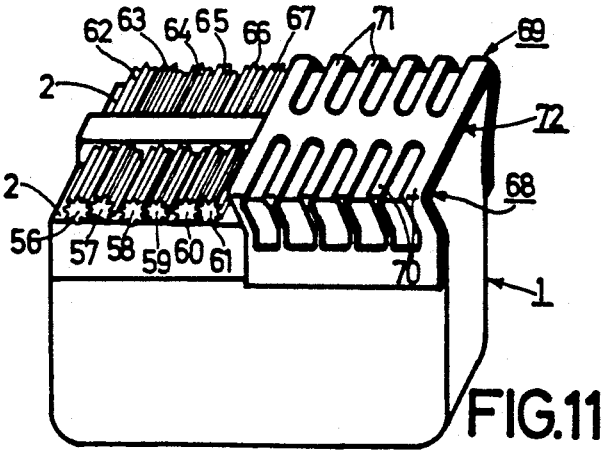
FIG. 11 shows the depilation apparatus of FIG. 9 with the protective cover fully slid away from the depilation rollers.
Figure 12:
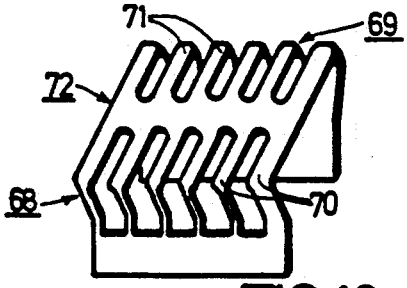
FIG. 12 shows the protective cover detached from the depilation apparatus shown in FIG. 9.

FIGS. 9, 10 and 11 show a depilation apparatus comprising six pairs of depilation rollers, of which each time two pairs of depilation rollers are disposed axially in tandem so as to be coaxial with one another, the freely projecting end portions of the depilation rollers of the two pairs being remote from one another, in a similar way as in the embodiment shown in FIGS. 3 and 4. In the present embodiment the depilation rollers, which bear the reference numerals 56 to 67, are provided with associated protective combs, i.e. a protective comb 68 for the depilation rollers 56 to 61 and a protective comb 69 for the depilation rollers 62 to 67, the spaced-apart comb teeth again extending in the axial direction of the depilation rollers. The comb teeth of the protective comb 68 bear the reference numeral 70 and those of the protective comb 69 bear the reference numeral 71. In this embodiment the two protective combs 68 and 69 are constructed as a protective cover 72, which surrounds the depilation rollers and which for optionally exposing or covering the depilation rollers is arranged on the apparatus so as to be movable in a direction transverse to the axial direction of the depilation rollers and, in the present case, is also constructed to be detachable from the apparatus. FIG. 9 shows the depilation apparatus with the protective cover 72 slid completely over the depilation rollers and FIG. 10 shows the depilation apparatus with the protective comb 72 partly moved away from the depilation rollers in a position in which two pairs of depilation rollers 56, 57 and 62, 63 are exposed, which may then be used for example for depilation without protective cover. FIG. 11 shows the depilation apparatus with the protective cover 72 in a position in which the protective combs expose all the depilation rollers 56 to 67, so that these rollers are readily accessible, for example for the purpose of cleaning. FIG. 12 shows the protective cover 72 separately, removed from the depilation apparatus. Obviously, it is also possible, for example, to make the protective cover or the protective combs only detachable from the depilation apparatus and not additionally movable, or only movable instead of being also detachable.

In the present embodiment the teeth 70 and 71 of the protective combs 68 and 69 respectively are constructed in such a way that they extend around the freely projecting end portions of the depilation rollers exposed by the opening 2 in the apparatus, which opening is now formed by two angularly offset steps of the apparatus housing, so that also at the location of the freely projecting end portions of the depilation rollers they provide both a comb action and skin protection. As can be seen, the comb teeth in the present embodiment fully enclose the freely projecting end portions of the depilation rollers, which is not strictly necessary but which in the present case results from the fact that the protective combs have been integrated to form a protective cover. It is obvious that it is readily possible to construct the teeth of the protective combs in such a way that they extend only partly around the freely projecting end portions of the depilation rollers in order to provide a satisfactory skin protection in so far as this is deemed necessary.

Figure 14:
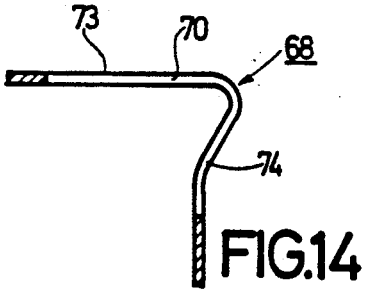
FIG. 14 is a sectional view of said part of the protective cover taken on the line XIV—XIV in FIG. 13.
Figure 13:
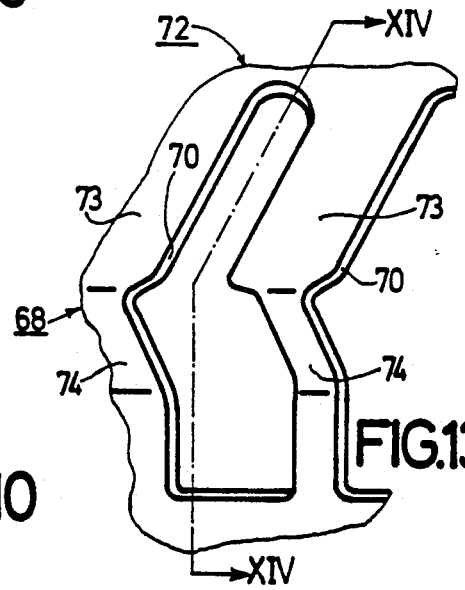
FIG. 13 shows a part of the protective cover of FIG. 12, to illustrate the shape of the comb teeth of a protective comb forming part of said cover.

FIGS. 13 and 14 show the construction of the comb teeth in the present embodiment in detail. As can be seen, the comb teeth, as is shown for the comb teeth 70, each have a flat portion 73 with which they extend over the circumferential surfaces of the depilation rollers and with which they are passed over the skin. This portion 73 is adjoined by a portion 74 which surrounds the freely projecting end portions of the depilation rollers and which in the present example has an acute V-shape relative to the portion 73. As the comb teeth are passed over the skin the inclined portions 74 of the comb teeth provide a shovel action, causing the hairs to be erected so that they can be gripped very effectively by the freely projecting end portions of the depilation rollers. Moreover, relative to the portion 73 with which they are passed over the skin, the comb teeth are tapered at the location of their portions 74 which surround the freely projecting end portions of the depilation rollers, as can be seen in FIG. 13. This results in the distance between two adjacent comb teeth i.e. the tooth gap, at the location of the freely projecting end portions of the depilation rollers, being larger than the distance between the portions 73 of the comb teeth with which they are passed over the skin. As a result of this, the portions 73 with which the comb teeth are passed over the skin provide an effective skin protection and, in addition, the portions 74 facilitate access of the hairs to the freely projecting ends of the depilation rollers owing to the enlarged gaps at the location of the freely projecting end portions of the depilation rollers. Therefore an epilation appartus comprising protective combs having comb teeth of such a shape will provide non-irritating depilation.

As will be apparent from the foregoing, a variety of modifications to the embodiments described above are possible without departing from the scope of the invention. This applies in particular to the construction and dimensioning of the depilation rollers themselves and to the protective combs which are used, if it is deemed necessary to provide such combs.

We claim:

1. A depilation apparatus comprising at least one pair of depilation rollers which are arranged at the location of a main opening in the apparatus which provides access to their circumferential surfaces, which rollers are rotatably supported, are rotatable in opposite directions, and extend in a direction parallel to the main opening to cooperate circumferentially with one another along their length, one of said rollers being drivable by means of a motor, the depilation rollers performing a rotary movement which is directed into the interior of the apparatus at the location where said rollers cooperate circumferentially, the depilation rollers being supported to project freely with one of their end portions extending transverse to the main opening, and an edge portion of the housing being recessed relative to said end portions to form an additional opening in the apparatus that at least partly exposes the freely projecting end portions of the depilation rollers.

2. A depilation apparatus as claimed in claim 1, wherein the freely projecting end portions of the depilation rollers are rounded.

3. A depilation apparatus as claimed in claim 2, in which the circumferential surfaces of the depilation rollers have an undulatory cross-sectional profile, and wherein the undulatory cross-sectional profile of the depilation rollers extends into the rounded end portions of said rollers.

4. A depilation apparatus as claimed in claim 2 or 3, in which the circumferential surfaces of the depilation rollers have an undulatory cross-sectional profile, and wherein the ends of the crests of the undulatory cross-sectional profiles of the depilation rollers which ends are situated at the location of the rounded end portions of the depilation rollers, are also rounded.

5. A depilation apparatus comprising at least two pairs of depilation rollers which are arranged at the location of an opening in the apparatus which provides access to their circumferential surfaces, which rollers are rotatably supported, are rotatable in opposite directions, and cooperate circumferentially with one another, one of said rollers being drivable by means of a motor, the depilation rollers performing a rotary movement which is directed into the interior of the apparatus at the location where the rollers cooperate circumferentially, the depilation rollers being supported to project freely with one of their end portions, the opening in the apparatus at least partly exposing the freely projecting end portions of the rollers;

wherein two pairs of depilation rollers, disposed axially in tandem, are arranged to be coaxial with one another and the freely projecting end portions of the depilation rollers of both pairs are remote from one another.

6. A depilation apparatus as claimed in claim 5, wherein the coaxial depilation rollers of the two pairs have a common roller shaft.

7. A depilation apparatus as claimed in claim 6, wherein the coaxial depilation rollers which are driven by the motor are rigidly connected to their roller shaft and the other coaxial depilation rollers are arranged on their roller shaft so as to be freely rotatable and to be axially movable to a limited extent.

8. A depilation apparatus as claimed in claim 7, wherein, for the limited axial movement of a depilation roller on its roller shaft, the depilation roller is provided with a collar at its end which is remote from the freely projecting end portion, which collar engages behind that end of the adjacent depilation roller which is remote from the freely projecting end portion.

9. A depilation apparatus comprising at least one pair of depilation rollers which are arranged at the location of an opening in the apparatus which provides access to their circumferential surfaces, which rollers are rotatably supported, are rotatable in opposite directions, and cooperate circumferentially with one another, one of said rollers being drivable by means of a motor, the depilation rollers performing a rotary movement which is directed into the interior of the apparatus at the location where said rollers cooperate circumferentially, the depilation rollers being supported to project freely with one of their end portions, an edge portion of the housing being recessed relative to the ends of the depilation rollers to form an opening in the apparatus that at least partly exposes the freely projecting end portions of the depilation rollers, and a protective comb associated with the depilation rollers, which comb extends over the opening in the apparatus and comprises spaced-apart comb teeth which extend in the axial direction of the depilation rollers.

10. A depilation apparatus as claimed in claim 9, wherein two adjacent comb teeth of the protective comb directly expose the area where the depilation rollers of a pair cooperate circumferentially with one another.

11. A depilation apparatus as claimed in claim 9 or 10, wherein the comb teeth of the protective comb at least partly enclose the freely projecting end portions of the depilation rollers which are exposed by the opening in the apparatus.

12. A depilation apparatus as claimed in claim 11, wherein at the location where they at least partly enclose the freely projecting end portions of the depilation rollers the comb teeth of the protective comb have an acute V-shape.

13. A depilation apparatus as claimed in claim 11, wherein the comb teeth of the protective comb are tapered at the location where they at least partly enclose the freely projecting end portions of the depilation rollers.

14. A depilation apparatus as claimed in claim 9, wherein the protective comb associated with the depilation rollers is arranged to be movable on the apparatus in a direction transverse to the axial direction of the depilation rollers for optionally exposing or covering the depilation rollers.

15. A depilation apparatus comprising at least one pair of depilation rollers which are arranged at the location of an opening in the apparatus which provides access to their circumferential surfaces, which rollers are rotatably supported, are rotatable in opposite directions, and cooperate circumferentially with one another, one of said rollers being drivable by means of a motor, the depilation rollers performing a rotary movement which is directed into the interior of the apparatus at the location where said rollers cooperate circumferentially, the depilation rollers being supported to project freely with one of their end portions, an edge portion of the housing being recessed relative to the ends of the depilation rollers to form an opening in the apparatus that at least partly exposes the freely projecting end portions of the depilation rollers, and a protective comb associated with the depilation rollers, which comb extends over the opening in the apparatus and is constructed as a protective cover surrounding the depilation rollers, which comb comprises spaced-apart comb teeth which extend in the axial direction of the depilation rollers, the comb teeth at least partly enclosing the freely projecting end portions of the depilation rollers which are exposed by the opening in the apparatus.

16. A depilation apparatus comprising at least one pair of depilation rollers which are arranged at the location of an opening in the apparatus which provides access to their circumferential surfaces, which rollers are rotatably supported, are rotatable in opposite directions, and cooperate circumferentially with one another, one of said rollers being drivable by means of a motor, the depilation rollers performing a rotary movement which is directed into the interior of the apparatus at the location where said rollers cooperate circumferentially, the depilation rollers being supported to project freely with one of their end portions, an edge portion of the housing being recessed relative to the ends of the depilation rollers to form an opening in the apparatus that at least partly exposes the freely projecting end portions of the depilation rollers, and a protective comb associated with the depilation rollers, which comb extends over the opening in the apparatus and is constructed to be detachable from the apparatus, which comb comprises spaced-apart comb teeth which extend in the axial direction of the depilation rollers.

* * * * *